US005690402A

United States Patent [19]

Koppe

[11] Patent Number: 5,690,402

[45] Date of Patent: Nov. 25, 1997

[54] PRODUCT DISPLAY CASE

[76] Inventor: Rudolf Koppe, 1251 Britannia Rd., Campbellville, Ontario L0P 1B0, Canada

[21] Appl. No.: 622,452

[22] Filed: Mar. 22, 1996

[51] Int. Cl.[6] ..... A47F 3/06

[52] U.S. Cl. ..... 312/128; 312/114; 312/118; 312/132; 312/139.2; 312/120

[58] Field of Search ..... 312/204, 114, 312/117, 118, 120, 122, 123, 128, 127, 131, 132, 138.1, 139.2, 198, 306, 287, 129, 130

[56] References Cited

U.S. PATENT DOCUMENTS

| | | | |
|---|---|---|---|
| 362,207 | 5/1887 | Dechent | 312/118 |
| 435,974 | 9/1890 | Motigny | 312/131 |
| 852,229 | 4/1907 | Joyce | 312/120 |
| 874,301 | 12/1907 | Cedarburg | 312/132 X |
| 1,068,062 | 7/1913 | Kallenbaugh et al. | 312/128 X |
| 1,800,769 | 4/1931 | White | 312/118 |
| 1,980,973 | 11/1934 | Alheit | 312/114 |
| 2,049,140 | 7/1936 | Schick | 312/122 |
| 2,510,759 | 6/1950 | Schnewind | 312/132 X |
| 2,681,262 | 6/1954 | Vincent | 312/287 X |
| 3,085,840 | 4/1963 | Senechal | 312/139.2 |
| 3,584,927 | 6/1971 | Ott | 312/128 X |
| 4,042,286 | 8/1977 | Olson et al. | 312/129 |
| 4,148,535 | 4/1979 | Fenwick | 312/139.2 X |
| 4,285,558 | 8/1981 | Medford | 312/128 X |
| 5,468,063 | 11/1995 | Simonek | 312/287 X |
| 5,496,103 | 3/1996 | Kozak | 312/118 |
| 5,590,940 | 1/1997 | Richard | 312/334.27 X |

FOREIGN PATENT DOCUMENTS

| | | | |
|---|---|---|---|
| 1021559 | 2/1953 | France | 312/128 |
| 49992 | 2/1941 | Netherlands | 312/128 |

*Primary Examiner*—Peter M. Cuomo
*Assistant Examiner*—James O. Hansen
*Attorney, Agent, or Firm*—Crossetta &Associates

[57] ABSTRACT

A novel product display case is disclosed having detachable and separately functional upper and lower units. The upper unit comprises a plurality of slidable display panels on which items can be secured for inspection, and can be slid aside to reveal shelves for the secure storage of items corresponding to the items on display. The lower unit comprises a display box which encases items secured for display and inspection, and is hingedly movable to reveal a plurality of shelves for the secure storage of items corresponding to items in the display box.

18 Claims, 4 Drawing Sheets

PRODUCT DISPLAY CASE

FIELD OF THE INVENTION

The present invention relates to a novel product display case which has the dual utility of providing a means for displaying a selection of diverse items in a securely mounted arrangement and a convenient means for maintaining a supply of displayed items in registered storage conveniently accessible to the salesperson or purchaser.

BACKGROUND OF THE INVENTION

There is a continuing need for a device suitable for displaying a plurality of diverse items for the convenient viewing of the purchasing public, yet secure the items from mishandling or theft while providing a convenient method to maintain storage of the displayed items for quick and easy retrieval.

In the retail sale of items, such as small, expensive or injurious items, there has been a continuing conflict between the necessity for adequately securing the items from theft or mishandling and the desire to provide an attractive marketing environment so as to maximize potential customer interest in purchasing the items.

In the time honored retail marketing tradition, potential customers generally prefer to handle the item being presented for sale so they may inspect and compare various of a selection of similar items before their selection for purchase is made. In the sales of small packaged items, this generally means opening the package and removing protective wrappings for the customer to handle and view the item. Upon making a selection, the customer generally prefers that the item be rewrapped or that a new originally wrapped package containing the item be provided for the actual sale. Such sales environment can require close supervision by retail clerks and if storage quantities of the item are not easily and conveniently available, usually requires the sales personnel to leave their customer in search of a stored unit.

In other retail environments, it has become common for store owners to provide limited shelf space for company representatives who provide a display and replenishing stock of items being sold through the display. The customer is thus left to his own means to inspect and compare the items and to then select the appropriate package from the stock provided at the shelf space for which payment at an appropriate cashier station in the store is then made. Such means of display and stock of items is generally problematic in that samples of small items, amongst a diverse selection of similar items, which may be provided for display become lost, stolen or scattered about the store and many packages become strewn about in the frenzy of determining which package contains which of the many displayed items.

It is an object of the present invention to provide a product display case with enhanced viewing of the product for inspection and comparison by the customer.

It is another object to provide a product display case which can secure items for display in such manner as to restrain mishandling thereof.

It is a further object of the invention to provide a display case for the registered identification of items for convenient retrieval from storage.

It is a still further object to provide a display case having a convenient means for storing quantities of the items in registered alignment with the objects being displayed.

These and other objects of the invention will become apparent from the following description of the invention.

SUMMARY OF THE INVENTION

The present invention is a display case having upper and lower, separately functional, display and storage units.

The lower unit constitutes a generally rectilinear case comprised of a generally horizontally disposed flat base panel, opposing generally vertically disposed side panels, a generally vertically disposed rear panel, a top, a front panel and a front display box. The base panel, opposing side panels, rear panel, top and front panel are arranged so as to form a case having a forward facing display opening angled from the vertical for access to the interior of the case. A front display box is hingedly mounted in the display opening such that in the closed position the interior of the case is closed to entry and in the open position the box pivots away from the opening allowing access to the interior of the case.

The interior of the case comprising the lower unit comprises a plurality of shelves for storage of items displayed in the display box. Generally such shelves are adjustably mounted.

The front display box comprises a generally rectilinear case having a generally transparent front panel and means for mounting items on the interior of the rear panel facing the front panel. In one embodiment the transparent front panel is movably mounted, preferably slidably mounted, to the front display box. It should be understood, by the term generally transparent is meant that an item mounted to the interior wall of the rear panel is visible therethrough and does not mean that the entire front panel must be transparent or that transparency must be complete.

In another embodiment the front display box is hingedly connected at about its lower border to a front panel of the lower unit. In a preferred embodiment, the transparent front panel is hingedly connected at its lower border to the display box and the display box is hingedly connected at its upper border to the top of the lower unit.

In one embodiment of the invention, the rear panel of the display box is perforated and the means for mounting items on the interior of the panel comprises a fastening means engageable through a perforation. In a preferred embodiment a mounting means comprises a strap means or the like which extends through a hole in the rear panel, around an item positioned against the interior side of the panel and back through another hole in the rear panel. In a most preferred embodiment such strap means comprises plastic tie means.

In another embodiment of the invention the interior side of the rear panel comprises means for identifying items mounted to said rear panel. In a still further embodiment said means for identifying correspond to identifying means on packaged items contained within said lower unit. In a preferred embodiment the position of the mounted item on the rear panel of the display box is in registered alignment with packaged items contained on shelves within said lower unit.

The lower and upper units can stand alone or be mounted together. In a preferred embodiment of the invention the upper unit is mounted to the top of the lower unit forming a combined product display case.

The upper unit constitutes a generally rectilinear case comprised of a generally horizontally disposed base wall, opposing generally vertically disposed side walls, a generally vertically disposed rear wall and a top.

The rear wall comprises a plurality of shelves which are horizontally mounted thereto, preferably adjustably mounted. The front of the upper unit comprises an opening, preferably having a transparent door mounted therein.

In a preferred embodiment a door is mounted in the front opening as a barrier to entry to the interior of the case. In a further embodiment, glass doors are slidably mounted in an arrangement to traverse the front opening on about parallel paths so that in a closed position the doors provide a barrier to entry through the front opening. In a first open position the doors are in opposing alignment and present a barrier to entry through one side or portion of the front opening. In a second open position the doors are in opposing alignment and present a barrier to entry through another side or portion of the front opening.

In one embodiment of the invention, sliding glass doors are roller mounted along parallel tracks mounted to the interior of the base wall of the upper unit. In another embodiment the interior of the base wall comprises parallel slots and a bottom edge of glass doors are mounted to said parallel slots. In a preferred embodiment the bottom edge of a glass door comprises a plastic glide mount.

The doors can comprise a locking means to secure them from unauthorized opening or closing and/or can comprise means for gripping the doors, such as a handle, indentation, hole or the like to enable convenient opening or closing of the doors.

Positioned between the rear wall and the front opening of the case are one or more, preferably a plurality such as two or more, slidable display panels. In a preferred embodiment the display panels are generally vertically arranged, are slidably mounted along about parallel paths, and comprise means for fastening an item to be displayed thereon.

In a preferred embodiment a plurality of generally flat display panels, having a forward facing display surface, are slidably mounted to traverse a width of the case on parallel paths spaced from the front opening toward the rear wall. In a first position two display panels are in opposing juxtaposition such that the display surface of a first display panel nearest the front opening of the case is visible from the front opening and obstructs viewing the display surface of an opposing second display panel juxtaposed behind it. In a second position the two display panels are arranged in adjacent alignment such that the display surface of the two display panels are both visible and appear in a side by side arrangement when observed through the front opening.

In such arrangement it is envisioned that a plurality of display panels are slidable arranged along spaced about parallel paths for alternate viewing of displayed items and obstruction of viewing by arrangement behind other display panels.

The display panels can comprise means for mounting items for display on the viewing surface and/or literature or the like. In one embodiment of the invention, a display panel is perforated and the means for mounting items on the display surface of the panel comprises a fastening means engageable through a perforation. In a preferred embodiment a mounting means comprises a strap means or the like which extends from the rear of the panel through a hole, around an item positioned against the display surface of the panel and back through another hole to the rear of the panel. In a most preferred embodiment such strap means comprises plastic tie means.

In another embodiment of the invention the display surface of the display panel comprises means for identifying items mounted to said panel. In a still further embodiment said means for identifying correspond to identifying means on packaged items contained on shelves within said upper unit rearward of said display panels. In a preferred embodiment the position of the mounted item on a display panel of the upper unit is in registered alignment with packaged items contained on shelves within said upper unit.

In one embodiment of the invention, the display panels are roller mounted along parallel tracks mounted to a top and/or base wall of the upper unit. In a preferred embodiment the interior of the base wall comprises parallel tracks and a bottom edge of the display panels are roller mounted to said parallel tracks.

The panels can comprise a locking means to secure them from unauthorized opening or closing and/or egress to the rear shelves and/or can comprise means for gripping the panels, such as a handle, indentation, hole or the like to enable convenient sliding of the panels from one position to another.

DETAILED DESCRIPTION OF THE INVENTION

Figure 1:
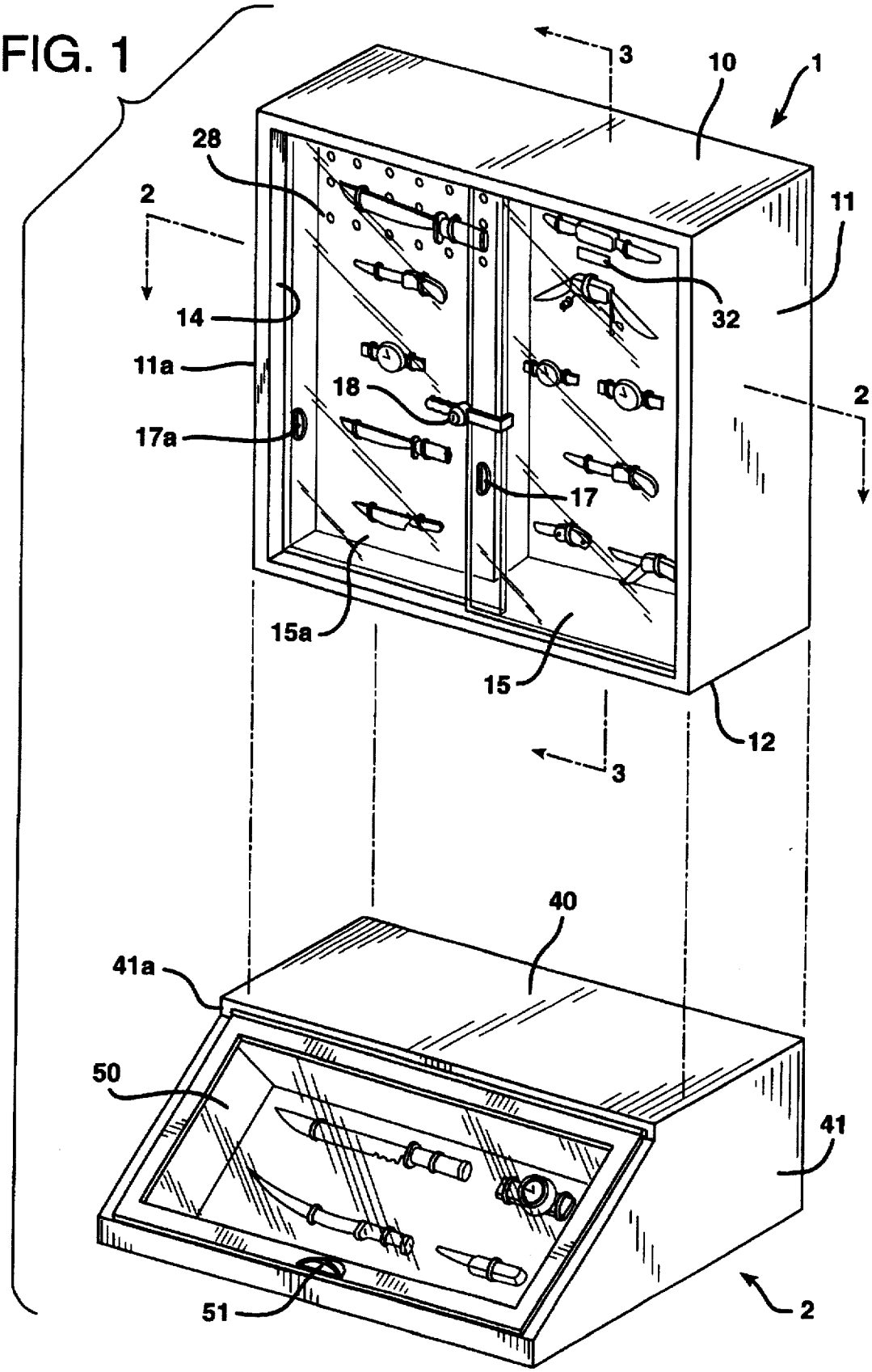
FIG. 1 illustrates an exploded perspective view of upper and lower units of a display case of the invention.
Figure 2:
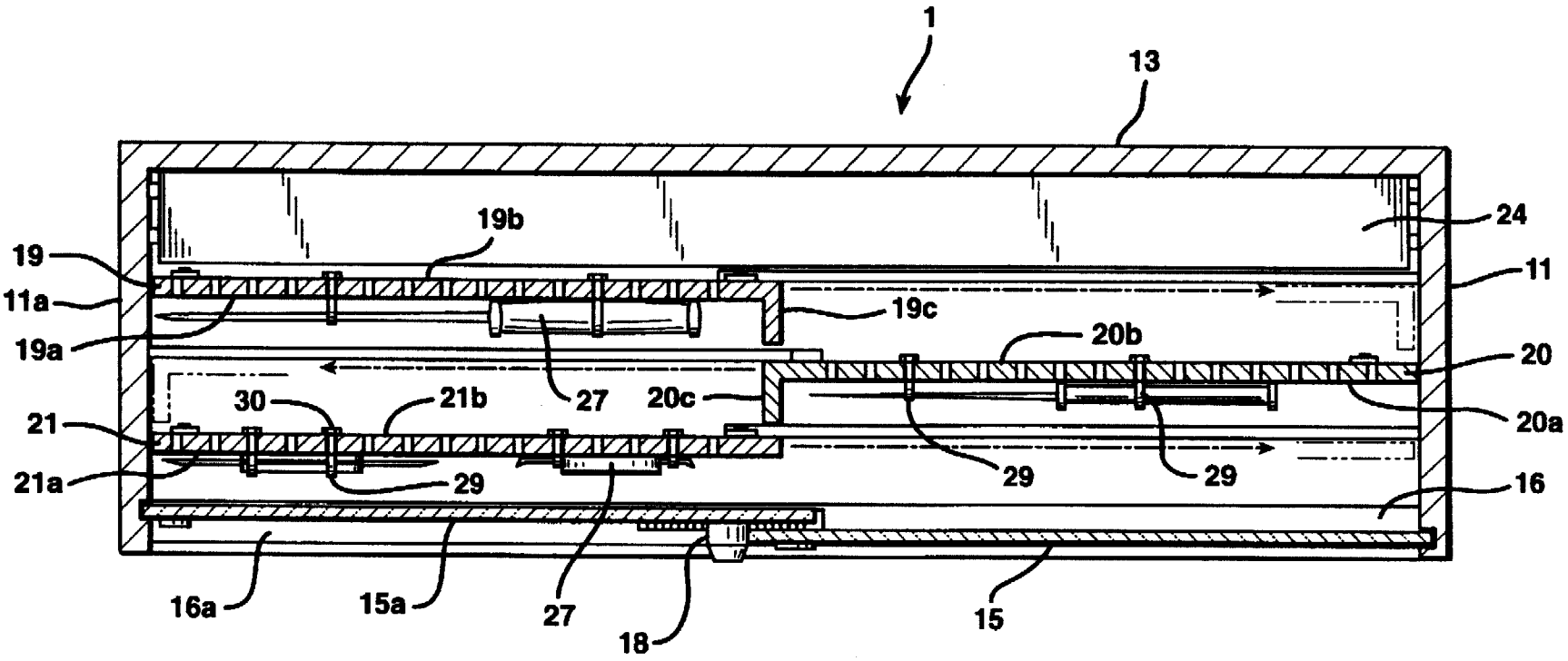
FIG. 2 illustrates a top elevational, sectional view of the upper unit of FIG. 1 taken along about line 2—2.
Figure 3:
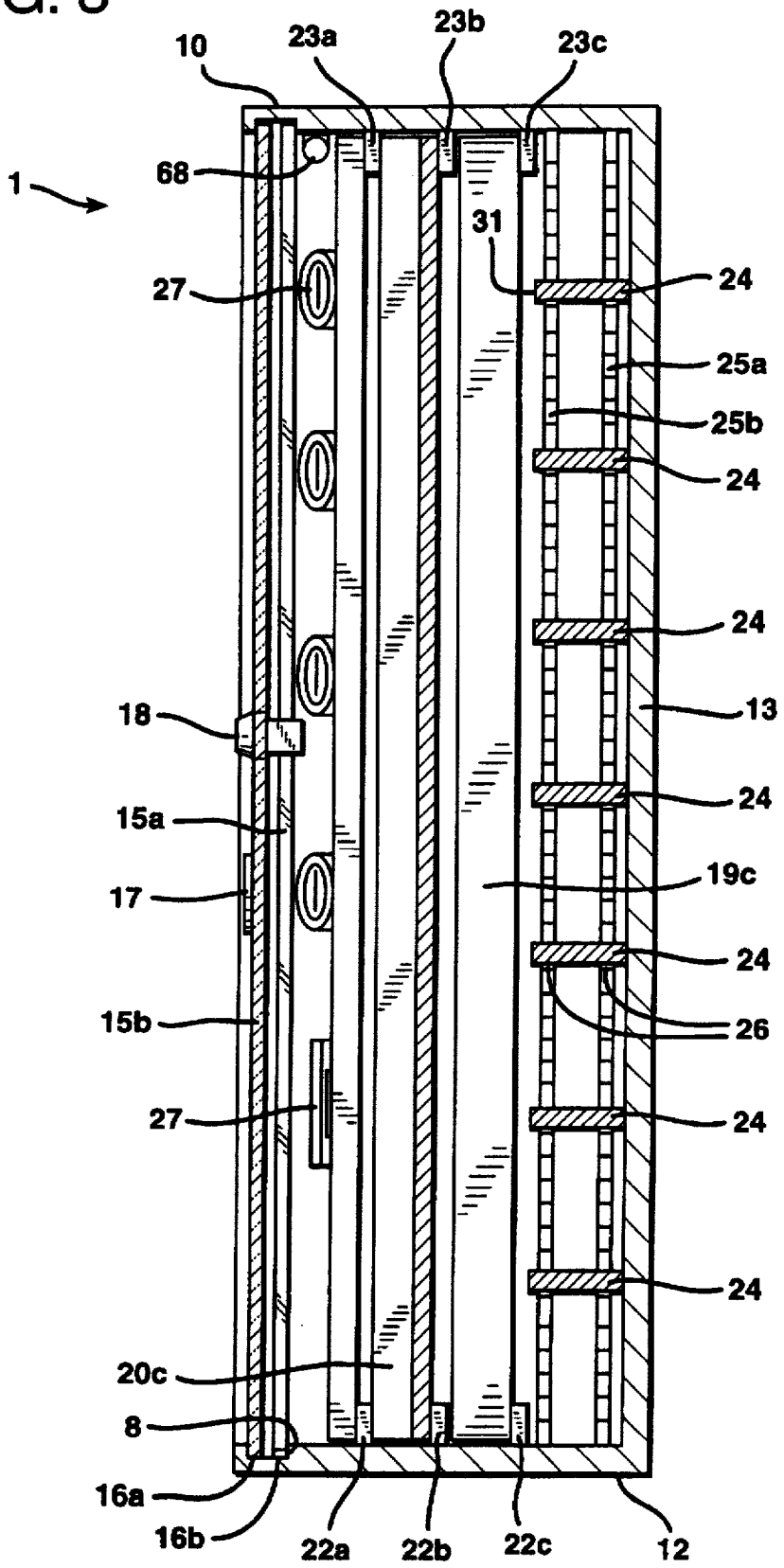
FIG. 3 illustrates a side elevational, sectional view of the upper unit of FIG. 1 taken along about line 3—3.
Figure 4:
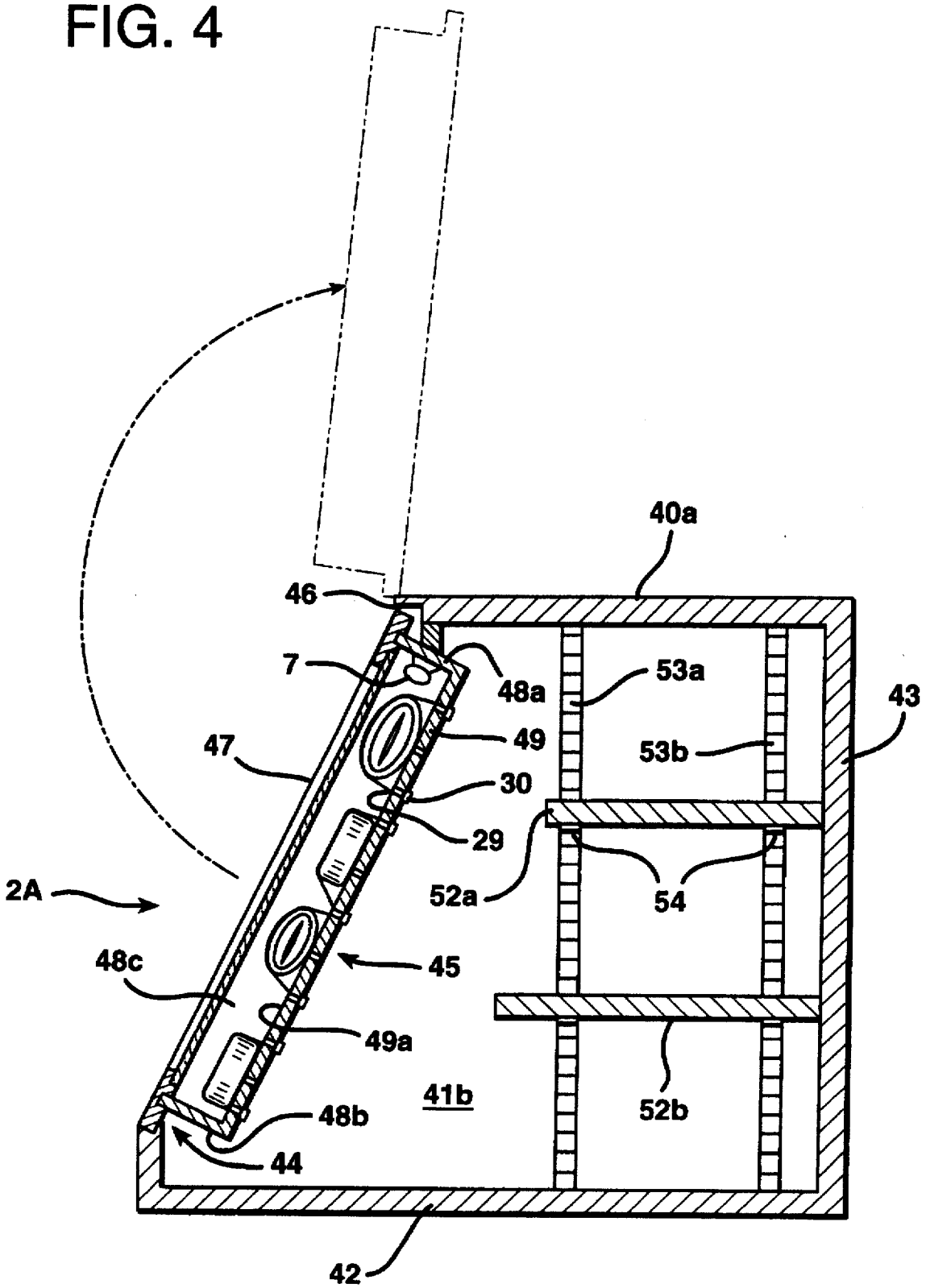
FIG. 4 illustrates a side elevational, sectional view of a further lower unit of the invention.

FIG. 1 illustrates upper and lower units in a preferred arrangement, while FIGS. 2 and 3 illustrate upper unit 1 alone and FIG. 4 illustrates a further lower unit alone.

Referring to upper unit 1, the embodiment illustrated depicts upper unit 1 as comprising top 10, side walls 11 and **11*a*, bottom wall 12 and rear wall 13. Front opening 14 comprises glass doors 15 and 15*a*, which are slidably mounted in generally parallel slots 16 and 16*a* of bottom wall 12 on glides 8, and comprise handles 17 and 17*a* and lock arrangement 18. In the depicted embodiment, light 68 illuminates display panels 19, 20 and 21, are illustrated having front display surfaces 19*a*, 20*a* and 21*a* respectively and rear surfaces 19*b*, 20*b* and 21*b* respectively. The display panels are illustrated as being slidable mounted through lower rollers 22*a*, 22*b* and 22*c* and upper rollers 23*a*, 23*b* and 23*c* in the case. Display panel 21 is depicted as a generally flat panel, while display panels 19 and 20 are shown with end caps 19*c* and 20*c***.

Spaced along the interior surface of rear wall 13 are a plurality of shelves 24, which are adjustably mounted to side mounts **25*a* and 25*b* through shelf supports 26. The front surfaces of the display panels may comprise a decorative covering or the like and constitutes the surface to which items 27 are mounted. Display panel 21 illustrated in FIG. 1 is shown as comprising holes 28 to enable mounting of items through mounting straps 29, which are fastened 30 at rear surface 21*b***. Generally the preferred mounting straps are plastic straps of the type which comprise a locking means at one end, through which the other end of the strap is passed, the locking means which generally comprises an edge which lockingly engages a groove in the other end of the strap.

Register tabs 31 are shown as being attached along shelves 24 and generally corresponding in adjacent location to item identification tags 32 positioned below display items 27. It should be understood that it is contemplated that the register tabs comprise a model identification or the like recited on boxed items and the presence of register tabs, identification tabs or the like is not required and/or may not correspond in adjacent position.

Lower units 2 and 2A, are depicted as comprising top 40, side walls 41 and 41*a*, and a front panel having a removable glass viewing portion 50 and handle 51. Lower unit 2A is illustrated as comprising top 40*a*, side wall 41*b*, bottom wall 42 and rear wall 43. Front opening 44 comprises display box 45 which is hingedly attached 46 to top 40*a* and comprises a front glass panel 47, side walls 48*a–d* rear display wall 49 and illuminating source 7. Display items are held to display surface 49*a* of display panel 49 by mounting straps 29, which are illustrated as fastened 30 at a rear surface of the display wall. Lower unit 2A is also shown as comprising a plurality of shelves 52*a–b*, which are adjustably mounted to side mounts 53*a* and 53*b* through shelf supports 54.

Units can be used alone or in any combination. For example two upper and/or two lower units, of the same or different size can be stacked to form a combination unit. When two upper units are stacked it is preferred that the bottom unit comprise a front kick plate and/or false base.

I claim:

1. A rectilinear display case having a generally vertically arranged rear wall, opposing side walls, top wall, bottom wall and front opening opposite said rear wall, said case having a plurality of horizontally arranged stacked shelves, spaced upwardly adjacent said rear wall and mounted at opposite ends to said opposing side walls;

said case having at about said front opening, spaced apart generally parallel, generally transparent door panels, arranged slidably mounted in said case in an arrangement which enables selective access through left and right sides of said front opening to an interior of said case, and a plurality of spaced apart, generally parallel display panels, arranged in the interior of said case positioned in front of said stacked shelves so as to conceal said shelves, each panel being roller mounted for slidable movement from a first position at one side of the interior of said case to a second position at another side of said interior of said case, said panels comprising means for mounting a display item thereto.

2. The display case of claim 1 wherein said shelves are adjustably mounted.

3. The display case of claim 1 wherein said door panels are slidably mounted to an interior surface of said bottom wall of said case.

4. The display case of claim 1 wherein said transparent door panel comprises means for gripping.

5. The display case of claim 1 wherein a display panel is roller mounted to the top wall of said case.

6. The display case of claim 1 wherein a display panel is roller mounted to the bottom wall of said upper case.

7. The display case of claim 1 wherein a display panel comprises an end cap.

8. The display case of claim 1 wherein a display panel comprises holes, arranged for insertion of straps for restraining items in place on said panel.

9. The display case of claim 8 wherein said straps comprise self-locking plastic ties.

10. The display case of claim 1 wherein said display panel comprises means for registering an item mounted thereto, to a corresponding packaged item contained on a shelf spaced upwardly along a rear wall of said case.

11. The display case of claim 10 wherein said corresponding packaged item is positioned on a shelf in proximate geographic correspondence to a registered item mounted to a display panel.

12. The display case of claim 11 wherein said means for registering comprises a numerical sequence.

13. The display case of claim 1 comprising locking means for restraining egress to shelves along a rear wall of said case.

14. The display case of claim 1 comprising display item illumination means.

15. A display case comprising:

a rectilinear upper case having a generally vertically arranged rear wall, opposing side walls, top wall, bottom wall and front opening opposite said rear wall, said upper case comprising a plurality of horizontally arranged shelves, spaced upwardly along said rear wall and mounted at opposite ends to said opposing side walls;

said upper case comprising at about said front opening, spaced apart generally parallel, generally transparent door panels, arranged slidably movable to a closed position which blocks entrance through said front opening to the interior of said upper case;

a plurality of spaced apart, generally parallel display panels, arranged in the interior of said upper case, each panel being slidably movable from a first position at one side of the interior of said upper case to a second position at another side of said interior of said upper case;

a lower case, having a generally vertically arranged rear wall, opposing side walls, a top wall, bottom wall and front display box opening, said front display box opening being arranged at an angle to the vertical and comprising a display box;

a display box, hingedly mounted in said front display box opening, having a generally transparent front panel and a rear display panel, said rear display panel comprising means for mounting items for display visible through said front panel said lower case comprising an area behind said display box having a plurality of horizontally arranged, adjustably mounted shelves, spaced upwardly along said rear wall for storage of displayed items.

16. The display case of claim 15 wherein said lower case comprises a plurality of horizontally arranged shelves, spaced upwardly along said rear wall of said lower case.

17. The display case of claim 16 wherein shelves of said lower case are adjustably mounted to said opposing side walls.

18. The display case of claim 15 wherein shelves of said upper case are adjustably mounted to said opposing side walls.

* * * * *